US008511488B2

(12) United States Patent
Poisson

(10) Patent No.: US 8,511,488 B2
(45) Date of Patent: Aug. 20, 2013

(54) SHELVING AND PROTECTIVE COVERING SYSTEM

(76) Inventor: Daniel G Poisson, Grantham, NH (US)

( * ) Notice: Subject to any disclaimer, the term of this patent is extended or adjusted under 35 U.S.C. 154(b) by 323 days.

(21) Appl. No.: 12/924,096

(22) Filed: Sep. 21, 2010

(65) Prior Publication Data

US 2012/0067839 A1 Mar. 22, 2012

(51) Int. Cl.

| | |
|---|---|
| ***A47F 5/08*** | (2006.01) |
| *A47F 5/00* | (2006.01) |
| *A41F 1/00* | (2006.01) |
| *A47C 27/045* | (2006.01) |

(52) U.S. Cl.

USPC ..... 211/153; 211/183; 24/458; 24/581.11

(58) Field of Classification Search

USPC ..... 211/134, 184, 181.1, 153, 183, 119.003, 211/90.03; 150/158; 108/90, 161; 24/297, 24/458, 453, 457, 292–295, 581.11; 411/508

See application file for complete search history.

(56) References Cited

U.S. PATENT DOCUMENTS

| | | | | |
|---|---|---|---|---|
| 2,375,726 | A * | 5/1945 | Bales | 108/109 |
| 3,554,383 | A * | 1/1971 | Ball | 211/153 |
| 4,688,961 | A * | 8/1987 | Shioda et al. | 403/389 |
| 4,890,746 | A * | 1/1990 | Trulaske, Sr. | 211/59.2 |
| 5,228,581 | A * | 7/1993 | Palladino et al. | 211/153 |
| 5,538,147 | A * | 7/1996 | Fucci | 211/153 |
| 5,597,077 | A * | 1/1997 | Hartmann | 211/134 |
| 5,697,302 | A * | 12/1997 | Putnam | 108/90 |
| 6,082,557 | A * | 7/2000 | Leahy | 211/59.3 |
| 6,401,945 | B1 * | 6/2002 | Gawel | 211/183 |
| 6,725,785 | B2 * | 4/2004 | Wang | 108/90 |
| 7,682,465 | B2 * | 3/2010 | Anderson et al. | 134/56 D |
| 7,699,277 | B2 * | 4/2010 | Bagnall | 248/206.5 |
| 8,083,432 | B2 * | 12/2011 | Limpert | 403/389 |
| 2002/0170870 | A1 * | 11/2002 | Callis | 211/119.003 |
| 2003/0223191 | A1 * | 12/2003 | Shyr | 361/683 |
| 2004/0004050 | A1 * | 1/2004 | Turan | 211/90.01 |
| 2004/0004052 | A1 * | 1/2004 | Young et al. | 211/183 |
| 2008/0041804 | A1 * | 2/2008 | Ward | 211/183 |
| 2009/0001037 | A1 * | 1/2009 | Wilcock | 211/119.003 |

* cited by examiner

*Primary Examiner* — Jonathan Liu
*Assistant Examiner* — Patrick Hawn
(74) *Attorney, Agent, or Firm* — Lambert & Associates; Gary E. Lambert; David J. Connaughton, Jr.

(57) ABSTRACT

A protective covering system for wire shelving, designed for ease of attachment to any wire shelving system. The protective covering system comprises a substantially rigid base which exhibits through areas for attachment of fastening devices between the upper surface of the substantially rigid base and the upper portion of the individual wire shelving member to be engaged. The gripping of the individual wire shelving member on at least each of four areas, in conjunction with the positioning of the upper head portion of the individual fastening members restrains the substantially rigid base from movement by limiting the three translational displacement components of degree of freedom.

10 Claims, 7 Drawing Sheets

SHELVING AND PROTECTIVE COVERING SYSTEM

FIELD OF THE INVENTION

The present invention relates generally to shelving systems and particularly to protective covering systems for wire shelving apparatuses.

BACKGROUND OF INVENTION

Within the construction arts, many newly erected structures, whether designed for office use or housing, include storage systems and closets comprising wire shelving. The design of common wire shelving used in homes and businesses serves the basic problem of inexpensive shelving for large items or items with bottoms/bases that span more than one section of cross wiring. Although this form of shelving is preferable due to weight, material and flexibility concerns, design considerations dictate that a gap should exist between each wire member in order to minimize weight and production cost and maximize efficiency. However, this inherent spacing between each wire member tends to create difficulty as items may tip over or even fall through the spaces between the wires.

When linen, clothing and the like are placed upon wire rod based storage systems comprising space between the individual wires, the existent space inherent creates wrinkling and soiling of the items stowed occurs. Furthermore, the inherent risk of smaller items tipping or falling through, or liquid or powder products spilling from a higher shelf onto items on lower storage shelves or the floor tends to render the wire shelf uni-dimensional. Moreover, when the breakdown of materials employed to coat the wire implements occurs, fine materials are left to interface with raw wire, which create chemical reactions often resulting in stains and tears in the fine materials.

An additional concern revolves around providing the consumer with a safe, aesthetically pleasing and flexible shelving system, that the consumer can install. This would include a more permanent design rather than cardboard, heavy cloth, or wood as these genres of systems could be prone to slippage hazards, become prohibitively heavy or even require the user to cut the material to size.

Within the art, concurrent attempts to rectify these shortcomings include utilization of flexible materials in conjunction with adhesive materials to conform to the shape of the wires and temper slippage, and employment of thin, flexible sheet materials supplied in rolls and comprising notched extending tabs that interlock with the wire cross members prevent slippage. Additional systems exemplify deployment of a spring clip or a downward extending tab that engages a front rod of the wire rack. These devices, however, tend to extend well into the special area beneath the wire shelf and may inhibit usage of that area.

Disadvantages of the concurrently employed systems illustrated, other objectives, features and advantages of the invention shall become apparent as the description thereof proceeds when considered in connection with the accompanying illustrative drawings.

SUMMARY OF THE INVENTION

The instant invention, as illustrated herein, is clearly not anticipated, rendered obvious, or even present in any of the prior art mechanisms, either alone or in any combination thereof. A protective covering system for shelving, particularly wire shelving, designed to compensate for the aforementioned drawbacks and limitations would afford significant improvement to numerous useful applications. Thus, the several embodiments of the instant invention are illustrated herein.

The instant system introduces an easily transported, fully fabricated shelving and covering system wherein the system is easily installable by artisan(s) and consumer(s) alike, as the system exhibits lightweight characteristics and durable yet ready manipulated materials. Therefore, the present system may be composed of inexpensive, lightweight and flexible materials which are permanent in structural nature and receptive to normal cleaning considerations, yet easily removable for subsequent reuse. The instant structure provides a shelving system and covering that is inexpensive to manufacture and features ease of installation.

The present system features a shelving unit and protection system comprising a substantially planar support and shelving cover member which is placed in contact with, and positioned to cover, the entirety of a horizontal surface of a wire shelf unit, is substantially transverse the upper circumferential portions to the wire members of a wire shelf rack. This system presents a design disposed to receive a system of two or more affixing, attaching or retaining devices, wherein the affixing devices make direct contact with at least the upper portion and/or side portion of the wire rack or shelving mechanism.

In one embodiment, the affixing devices may contact only the upper portion of the wire-frame structure. In additional embodiments, the affixing device may contact the side portions of the wire, or even engulf the entire circumference of the individual wire shelving section at issue. As the affixing devices are oriented in a parallel direction to the widthwise dimension of the individual shelf members, that is, oriented so that the lengthwise dimension of the affixing devices is parallel to the actual wires and perpendicular to the support wires.

Thus, the affixing devices prevent sliding along the lengthwise and width wise component and sideways motion of the shelf system. Moreover, the two or more affixing, attaching or retaining devices may be aligned to counteract rotational moments that might occur upon contact by goods to be stored upon the shelving, as the affixing members may be spaced in opposing rows and on opposing lengthwise sides of the substantially planar member, also known as the substantially rigid base.

The substantially planar member may be manufactured from translucent, opaque or even solidly colored materials of any chosen color to meet décor requirements. The substantially planar member of the shelf unit may be manufactured in a wide variety of ways. In one embodiment the mold formed or extruded, depending on the material from which the substantially planar member will be created, particularly if polymer materials are utilized. The substantially planar member may also be stamped, as may the plurality of apertures be stamped from the substantially planar member after fabrication. The apertures may also be pre-molded. Further, the two or more affixing, attaching or retaining members or devices may comprise a plurality of affixing devices and the substantially planar member may thus be disposed to receive the plurality of retaining members. The two or more affixing, attaching or retaining devices should contact only one wire frame member and not the support members.

The foregoing and other objects, features and advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

Accordingly, a wire shelving and protective covering system and accompanying enhancements its component elements are herein described, which achieve these objectives, plus other advantages and enhancements. These improvements to the art will be apparent from the following description of the invention when considered in conjunction with the accompanying drawings wherein there has thus been outlined, rather broadly, the more important features of the wire shelving protective and covering system in order that the detailed description thereof that follows may be better understood, and in order that the present contribution to the art may be better appreciated.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

These, together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention. Other features and advantages of the present invention will become apparent from the following description of the preferred embodiment(s), taken in conjunction with the accompanying drawings, which illustrate, by way of example, the principles of the invention.

Figure 1:
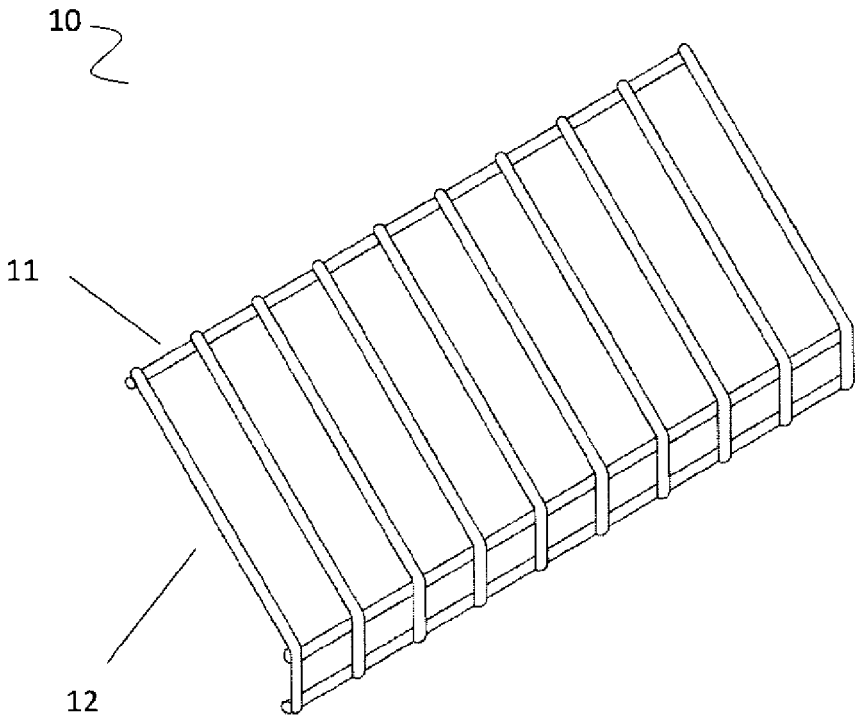
FIG. 1 is a perspective view of an embodiment of a wire rack utilized by the present invention.
Figure 2:
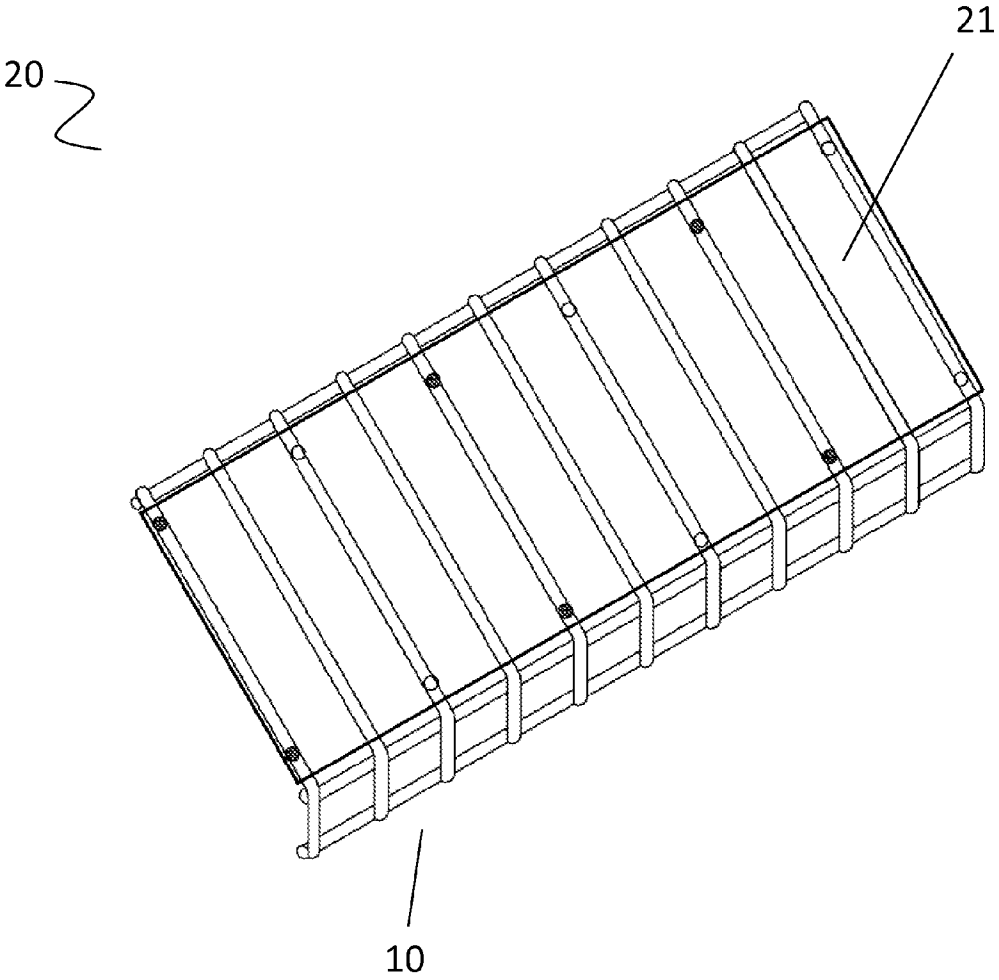
FIG. 2 is a perspective view translucent of an embodiment of a wire rack utilized by the present invention.
Figure 3:
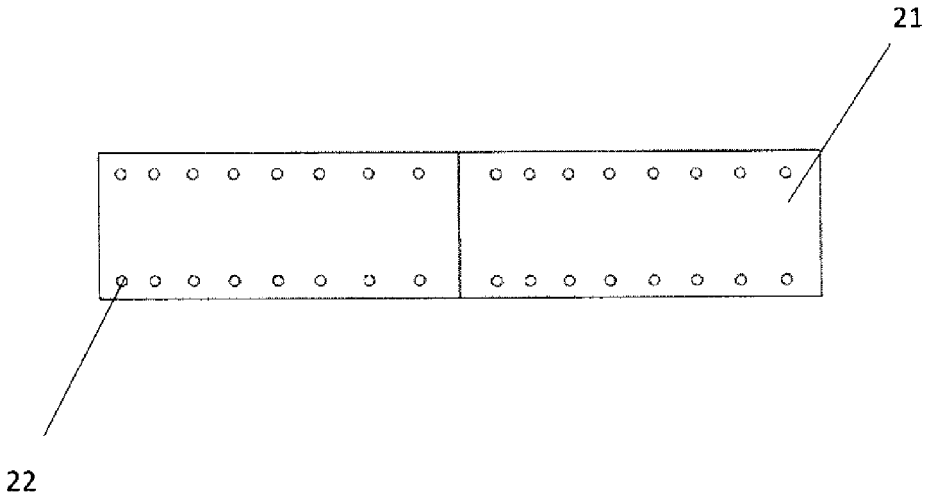
FIG. 3 is a top plan view of one embodiment of the present invention illustrating substantially planar support and shelving cover member of the present invention illustrating the v-channel located in the middle area.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although some embodiments of the invention have been herein described, it is understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalents thereof.

DETAILED DESCRIPTION OF THE INVENTION

The detailed description set forth below in connection with the appended drawings is intended as a description of presently-preferred embodiments of the invention and does not represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention, such as tremolos used in a variety of applications.

Referring now to the figures to better illustrate the present invention, in FIGS. 1-8, there is shown one embodiment of the shelving system and accompanying protective covering system comprising a wire rack 10 comprising at least two adjacent, parallel, spaced-apart support rods 11 and a plurality of parallel, spaced-apart, support wires 12 fastened at right angles to said support rods. The system may also include an upper surface protective covering system 20 comprising a substantially rigid base 21 comprising a series or plurality of, but at least two apertures 22 disposed to receive a series or plurality of, but at least two fastening, affixing or retaining devices 31 between the upper surface 23 of the substantially rigid base 21 and the upper portion or surface 13 of the individual wire shelving member to be engaged.

In one embodiment of the instant system, the substantially rigid base 21 may comprise 13 premolded holes or apertures 22 per four foot length of sheet and may also comprise a v-shaped cutaway, channel or groove at the midsection, the two foot mark.

The system may also include at least two stand alone fastening members 31 comprising an upper head member 32 comprising an upper head member upper portion 33 and an upper head member lower portion 34, wherein the upper head member lower portion 34 may directly contact the upper surface 23 of the substantially rigid base 21, but does not contact the support rods. Thus, only the upper head member lower portion 34 physically and directly contacts the support wires. Additionally, the fastening members 31 comprise a lower member 35, which contacts the wire shelving members and not the support rods of a wire shelving system. The fastening device lower member 35 may be made of a substantially rigid material, designed to afford just enough flexure to allow for the fastening device lower member 35 to fit through the apertures 22 of the substantially rigid base 21 and upon passage through apertures, the fastening device lower member 35 may securely encompass at very least the upper portion of the respective wire for attachment. The fastening device lower member 35 may be substantially u-shaped and become almost v-shaped upon passing though the aperture 22. The fastening device lower member 35 may be substantially diamond-shaped.

Figure 6:
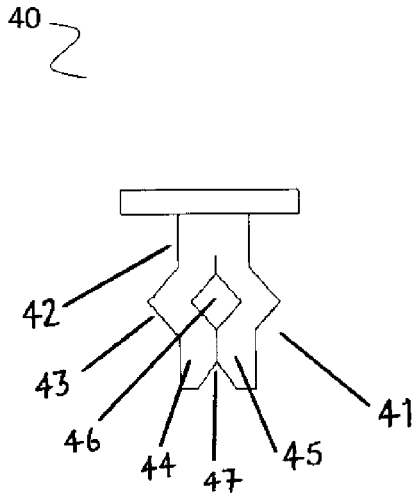
FIG. 6 is a front elevational view of another embodiment of the fastening or attachment device of the instant invention.
Figure 7:
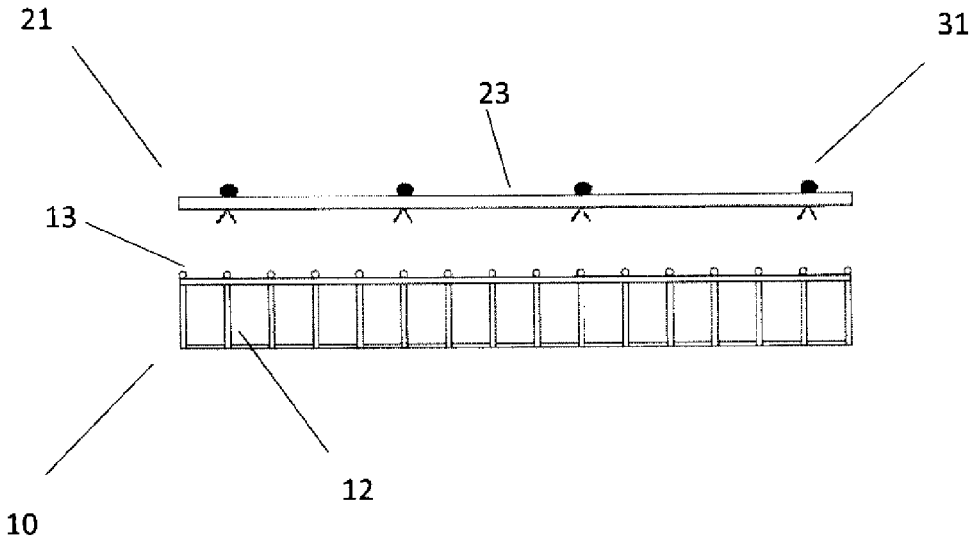
FIG. 7 is a front elevational view of the embodiment of the substantially planar support and shelving cover member of the present invention; and, FIG. 8 is a top plan view of an additional embodiment of the present invention illustrating the use of the substantially planar member, with no v-channel and further illustrating the fastening devices placed within the apertures.
Figure 8:
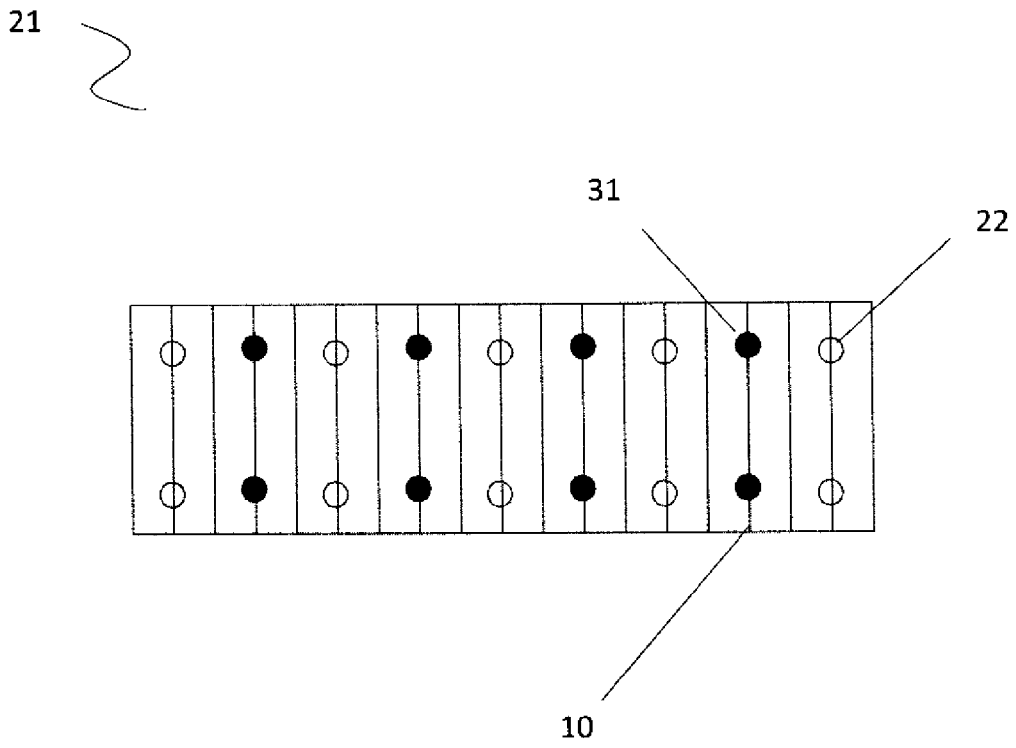

In another embodiment, illustrated in FIG. 6, the lower member 41 may comprise an upper section 42 and a diamond-shaped lower section 43, the lower member 41 sized to fit through one of the at least two apertures 22, the upper section 42 having a length equal to or greater than a thickness of the substantially rigid base 21 (as illustrated in FIG. 7), the diamond-shaped lower section 43 having a first prong 44 and a second prong 45, the first prong 44 and the second prong 45 defining a hollow diamond-shaped aperture 46 therebetween, the hollow diamond-shaped aperture 46 accessible by only one of the plurality of support wires 12 through a v-shaped opening 47 and sized to removably and lockingly completely surround only one of the plurality of support wires 12, the v-shaped opening 47 being formed when the first prong 44 and the second prong 45 are in contact when at rest, the v-shaped opening 47 configured to receive and snap over only one of the plurality of support wires 12 when the first prong 44 and the second prong 45 are urged apart.

Also, the shelving system and accompanying protective covering system may disposed wherein the apertures 22 are may also comprise a series of two parallel opposingly spaced rows of apertures 22, disposed to receive a plurality or series of fastening devices 31. Further, the two stand alone fastening members 31 may be placed in two opposingly disposed apertures 22 of the at least two apertures 22 disposed to receive fastening devices of the substantially rigid base, in order to prevent rotation of the substantially rigid base and may also pair with a corresponding individual of the parallel opposingly spaced rows of apertures disposed to receive fastening devices.

Figure 4:
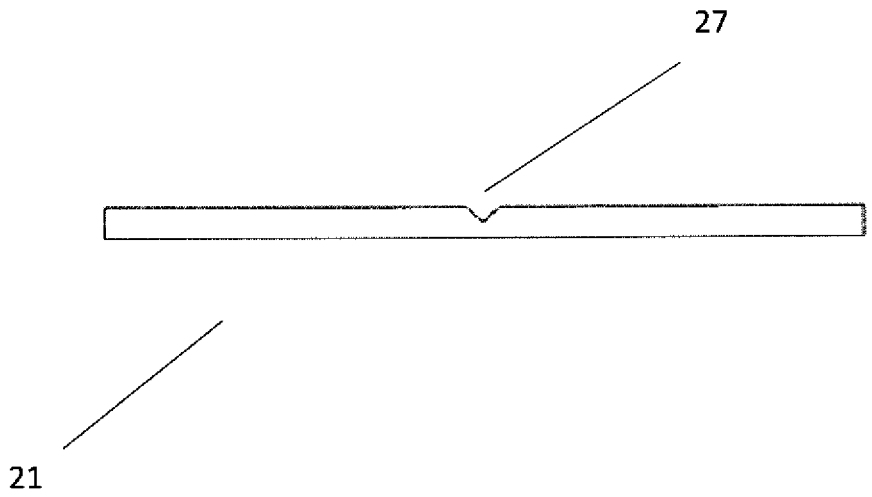
FIG. 4 is a side elevational view of the embodiment of FIG. 3 of the substantially planar support and shelving cover member of the present invention illustrating the v-channel located in the middle area.

Thus, the fastening members are simultaneously in physical communication with the apertures 22 disposed to receive fastening devices 31 between the upper surface of the substantially rigid base and the upper portion of the individual wire shelving member to be engaged. And, the fastening members should be placed in opposingly disposed apertures of substantially rigid base in order to prevent rotation of the substantially rigid base. Furthermore, the substantially rigid base may be substantially transparent or translucent, or may even be opaque and possess any color chosen by the individual. The substantially rigid base may be manufactured from plexi-glass or other such materials and/or polymeric or composite variations. FIG. 4 illustrates one embodiment of the present invention wherein the substantially planar support and shelving cover member of the present invention comprise a v-channel 27 located in the median, middle or central area of the member.

Figure 5:
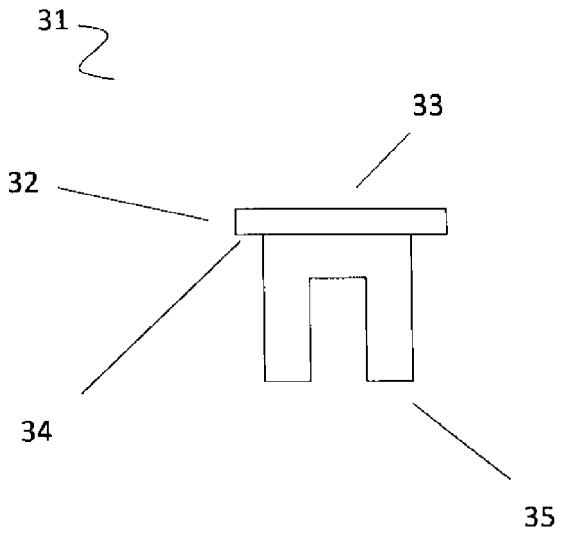
FIG. 5 is a front elevational view of one embodiment of the fastening or attachment device of the instant invention.

The fastening devices or members 31 may comprise a design of custom rubberized pins which exhibit the required flexure, or may be manufactured from other such materials and/or polymeric or composite variations. As illustrated in FIG. 5, in the substantially u-shaped embodiment which becomes substantially v-shaped upon deployment, the fastening devices 31 may comprise a ½ inch in diameter upper head portion and ⅜ inch in diameter lower portion with a ⅛ slot, leaving each semi circular leg at approximately ⅛ inch. In one embodiment, the overall height of the pin should be ½ inch and the lower portion height should be ⅜ inch.

In another embodiment, illustrated in FIG. 6, the fastening devices 40 may comprise a substantially diamond shaped lower portion dispose to entirely engulf the particular wire to be engaged.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

I claim:

1. A shelving system and accompanying protective covering system comprising:

a wire rack comprising at least two adjacent, parallel, spaced-apart support rods and a plurality of parallel, spaced-apart, support wires fastened at right angles to said support rods;

an upper surface protective covering system comprising:

a substantially rigid base positioned above the wire rack and having an upper surface and a lower surface, the lower surface abutting the wire rack, the substantially rigid base having at least two apertures extending completely through the substantially rigid base from the upper surface to the lower surface, each of the at least two apertures receiving a fastening member, each one of the fastening members positioned between the upper surface of the substantially rigid base and only one of the plurality of support wires of the wire rack, each one of the fastening members attaching directly to only one of the plurality of support wires, the fastening members securing the substantially rigid base to the wire rack, the fastening members comprising:

an upper head member and a lower member, the upper head member comprising an upper portion and a lower portion, wherein the lower portion directly contacts the upper surface of the substantially rigid base and does not contact the support wires, the upper head member being formed as a circular disc, having a diameter greater than a width of the lower member, the diameter of the upper head member being greater than a diameter of each of the at least two apertures, the lower member comprising:

an upper section and a diamond-shaped lower section, the lower member sized to fit through one of the at least two apertures, the upper section having a length equal to or greater than a thickness of the substantially rigid base, the diamond-shaped lower section having a first prong and a second prong, the first prong and the second prong defining a hollow diamond-shaped aperture therebetween, the hollow diamond-shaped aperture accessible by only one of the plurality of support wires through a v-shaped opening and sized to removably and lockingly completely surround only one of the plurality of support wires, the v-shaped opening being formed when the first prong and the second prong are in contact when at rest, the v-shaped opening configured to receive and snap over only one of the plurality of support wires when the first prong and the second prong are urged apart.

2. The shelving system and accompanying protective covering system of claim 1 wherein the at least two apertures disposed to receive fastening members comprise a series of two parallel opposingly spaced rows of apertures disposed to receive fastening member.

3. The shelving system and accompanying protective covering system of claim 2 wherein the fastening members are placed in two opposingly disposed apertures of the at least two apertures disposed to receive fastening members of the substantially rigid base, in order to prevent rotation of the substantially rigid base.

4. The shelving system and accompanying protective covering system of claim 2 wherein the fastening members further comprise a series of fastening members for pairing with a corresponding individual of the parallel opposingly spaced rows of apertures disposed to receive fastening members.

5. The shelving system and accompanying protective covering system of claim 1 wherein the fastening members are in physical communication with the at least two apertures disposed to receive fastening members between the upper surface of the substantially rigid base and the upper portion of the individual wire shelving member to be engaged.

6. The shelving system and accompanying protective covering system of claim 1 wherein the fastening members are placed in opposingly disposed apertures of substantially rigid base in order to prevent rotation of the substantially rigid base.

7. The shelving system and accompanying protective covering system of claim 1 wherein the substantially rigid base is substantially transparent.

8. The shelving system and accompanying protective covering system of claim 1 wherein the substantially rigid base is substantially opaque.

9. The shelving system and accompanying protective covering system of claim 1 wherein the substantially rigid base comprises a v-shaped mid section cutout portion oriented along a width of the substantially rigid base.

10. The shelving system and accompanying protective covering system of claim 1 wherein the wire rack comprises two adjacent parallel, spaced-apart support rods, one at each outer length of the wire rack; and wherein the substantially rigid base comprises two rows of the at least two apertures each row aligned along a length of the substantially rigid base, a first row being aligned to be just inside one of the adjacent parallel, spaced-apart support rods when the substantially rigid base is aligned on top of the wire rack, and a second row being aligned to be just inside the other of the adjacent parallel, spaced-apart support rods when the substantially rigid base is aligned on top of the wire rack.

* * * * *